US006645006B1

(12) United States Patent
Crisanti et al.

(10) Patent No.: US 6,645,006 B1
(45) Date of Patent: Nov. 11, 2003

(54) ELECTRICAL CONNECTOR

(75) Inventors: Peter John Crisanti, Windsor, CT (US); Erich Ruman, Waterbury, CT (US); David Edward Dowden, Ontario, NY (US); Donald George Witzel, Pittsford, NY (US)

(73) Assignees: Mannesmann VDO AG, Frankfurt (DE); Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/609,619

(22) Filed: Jul. 5, 2000

(51) Int. Cl.[7] ..... H01R 1/01
(52) U.S. Cl. ..... 439/564; 439/954
(58) Field of Search ..... 439/564, 565, 439/569, 582, 954

(56) References Cited

U.S. PATENT DOCUMENTS

| | | | | | |
|---|---|---|---|---|---|
| 1,034,159 | A | * | 7/1912 | Sparks | 439/564 |
| 3,432,798 | A | * | 3/1969 | Brishka | 439/582 |
| 3,711,815 | A | * | 1/1973 | Pierce et al. | 439/319 |
| 4,402,897 | A | | 9/1983 | Cross et al. | |
| 4,789,346 | A | * | 12/1988 | Frantz | 439/80 |
| 4,921,437 | A | * | 5/1990 | Cooper et al. | 439/275 |
| 5,007,862 | A | * | 4/1991 | Defibaugh et al. | 439/607 |
| 5,316,499 | A | * | 5/1994 | Scannelli et al. | 439/534 |
| 5,882,226 | A | * | 3/1999 | Bell et al. | 439/582 |
| 5,951,306 | A | | 9/1999 | Millhimes | |
| 5,954,520 | A | | 9/1999 | Schmidt | |
| 5,980,329 | A | * | 11/1999 | Klein et al. | 439/736 |
| 6,076,691 | A | * | 6/2000 | Belinky et al. | 220/3.9 |
| 6,155,875 | A | * | 12/2000 | Ineson | 439/564 |
| 6,439,909 | B1 | * | 8/2002 | Polgar et al. | 439/248 |

FOREIGN PATENT DOCUMENTS

| | | |
|---|---|---|
| EP | 0954068 A1 | 11/2000 |
| WO | WO 98/53530 | 11/1998 |

* cited by examiner

*Primary Examiner*—Lynn D. Feild
*Assistant Examiner*—Son V. Nguyen

(57) ABSTRACT

An electrical connector having a housing, a plurality of conductive terminals supported within the housing, and a flange extending outward from the housing is disclosed. The flange has a single mounting notch therein that is formed during the manufacturing process to adapt the connector for use in a particular angular mounting position. A method of manufacturing such an electrical connector is also disclosed.

9 Claims, 3 Drawing Sheets

ELECTRICAL CONNECTOR

BACKGROUND OF THE INVENTION

1. Field of the Invention

The present invention generally relates to electrical connectors for electrical devices, such as motors or sensors. More particularly, the invention relates to electrical connectors that include a flange having a single notch incorporated therein to adapt the connector to be mounted at a predetermined angle and to the methods of manufacturing such electrical connectors.

2. Discussion of the Prior Art

Electrical devices of many types may be used in environments that require particular wiring routings to avoid physical interference with other components or environmental hazards such as unwanted electrical interference or contact with hot surfaces. For example, this is readily apparent in the varying under-hood wiring layouts required in different motor vehicles having different engines or under-hood systems configurations. Continuing with the example of use in a motor vehicle, some devices, such as the motor of a specific idle air control valve, might find use in a variety of different vehicles. However, the different wiring routings required in different types of vehicles may require different electrical connector mounting angles to allow proper installation, operation and removal of the device and the wiring plug which mates with the electrical connector on the device. For instance, the wiring plug for a vehicle of a first type may need to approach the connector for the device horizontally, while in a vehicle of a second type it may need to approach the connector vertically or at some angle therebetween. These two different vehicle applications may be able to use the same motor or other device, but may require different electrical connectors to provide the respective different mounting angles to accommodate the necessary wiring routings.

Rather than use entirely different electrical connectors for different vehicles, it is desirable to a have single main connector housing design having an extended flange around the housing design into which a mounting notch may be formed to mount the connector at a specific angle. Furthermore, rather than equip different vehicles with different component connectors configured to accept a wiring plug approaching from only one angle, it is desirable to have a single basic connector design that can be easily adapted through the manufacturing process to provide one of a plurality of different mounting angles. Indeed, there are prior art electrical connectors that are manufactured to be adjustable between multiple angular positions. However, such connectors that have adjustable mounting angles tend to be complex and expensive to produce. Also, due to the nature of manufacturing and assembly processes, it is undesirable to permit a connector to have more than one mounting position available. Therefore, to avoid the possibility of improper connector installation and wiring routing, it is preferred to limit a connector to a single mounting angle. Moreover, for sealing and component integrity purposes, it is undesirable to have the connector housing consist of multiple housing sections which hinge or rotate relative to each other to obtain different connector mounting angles.

In light of the shortcomings and undesirable features commonly found in prior art electrical connector constructions, there exists a need for electrical connectors of simple construction that has an extended flange onto which a mounting notch can be formed, and that can be adapted through the manufacturing process to provide one of a plurality of potential connector mounting angles. It further is desirable to have the connector include a light-weight, molded dielectric housing. It further is advantageous to have the connector be adapted to be held at a single mounting angle and be secured to a product assembly by means of a single fastener. The present invention overcomes disadvantages of prior connectors, while providing the above-mentioned desirable features.

SUMMARY OF THE INVENTION

The purpose and advantages of the invention will be set forth in and apparent from the description and drawings that follow, as well as will be learned by practice of the invention disclosed and claimed herein.

The present invention is generally embodied in an electrical connector. In accordance with one embodiment of the invention, the connector comprises a housing, a plurality of conductive terminals supported within the housing, and a flange extending outward from the housing, the flange having a single mounting notch therein that is formed during the manufacturing process to adapt the connector for use in a particular angular mounting position. In a preferred embodiment of the invention, the conductive terminals are over-molded into the connector housing, the flange and housing are monolithically molded of a dielectrical material, and the flange of the connector extends outward from less than the entire perimeter of the housing.

The manufacture of the connector in accordance with an embodiment of the present invention involves molding of the housing of the connector. The housing is molded to incorporate a flange, and a mounting notch is formed in the flange to adapt the connector for use in a particular angular mounting position. The mounting notch can be formed in the flange in a number of ways. In one embodiment, the mold of the housing incorporates a moveable key to form the mounting notch. The movable key is placed at a predetermined position corresponding to the desired location of the mounting notch before the housing is molded, and when the housing is molded, the key creates a mounting notch on the flange corresponding to the desired mounting angle of the connector. In another embodiment of the invention, the mold for the housing is configured to create a flange on the housing without a mounting notch in the flange. The mounting notch is then machined onto the flange at a predetermined location corresponding to the desired mounting angle of the connector. In still another embodiment of the present invention, multiple molds are used, each mold designed to manufacture a specific connector having a housing incorporating a flange, the flange having a mounting notch at a specific location corresponding to the desired mounting angle of the particular connector. In a preferred embodiment of the invention, conductive terminals are over-molded into the connector housing during the manufacturing process, the flange and housing are monolithically molded of a dielectrical material, and the flange of the connector extends outward from less than the entire perimeter of the housing.

One skilled in the art will appreciate that this invention could be utilized in many different electrical connector settings where a common device may require different particular mounting angles in different assembly situations.

BRIEF DESCRIPTION OF THE DRAWINGS

In describing the preferred embodiment, reference is made to the accompanying drawings wherein like parts have like reference numerals, and wherein.

It should be understood that the drawings are not to scale. It should also be understood that, as discussed below, the present invention is not limited to the embodiment illustrated.

DETAILED DESCRIPTION OF THE PREFERRED EMBODIMENT

Although one skilled in the art will appreciate that the invention has potential for very broad application with many electrical devices, an exemplary embodiment of a connector made in accordance with the invention is disclosed herein in conjunction with a motor of an idle air control valve for vehicle internal combustion engines. The idle air control valve, motor and engagement with a connector are described in detail in U.S. patent application Ser. No. 09/240,527.

Figure 1:
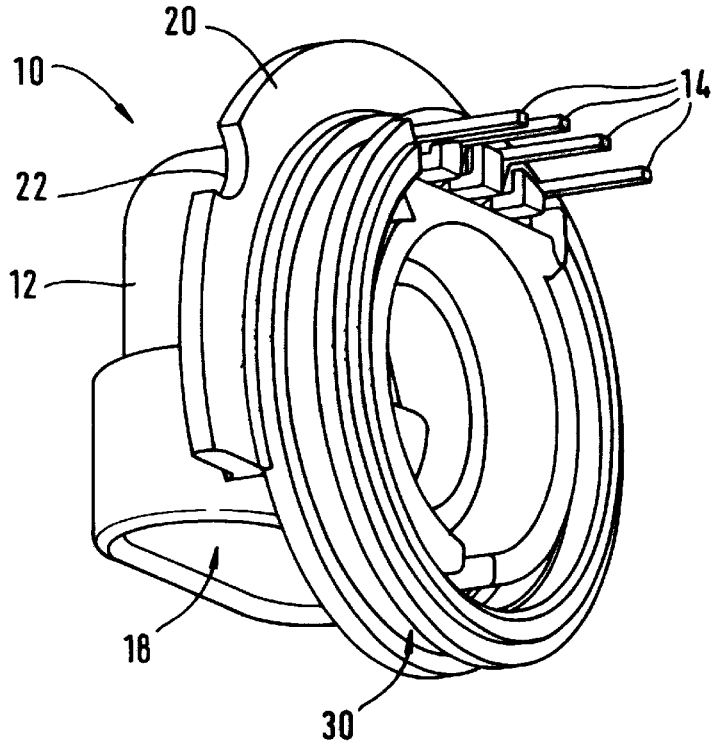
FIG. 1 is a front perspective view of an embodiment of an electrical connector in accordance with the invention.
Figure 2:
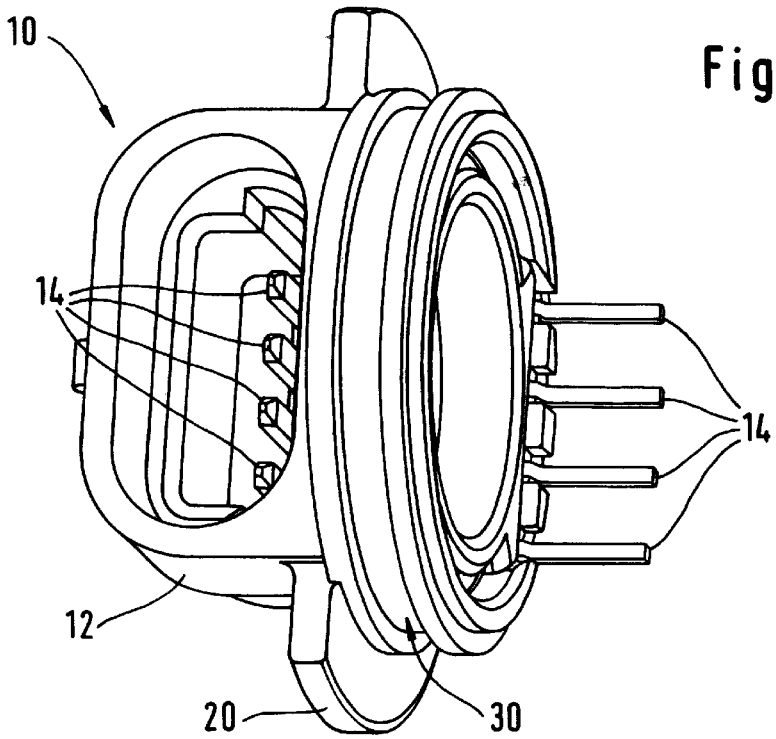
FIG. 2 is a bottom perspective view of the connector shown in FIG. 1.
Figure 3:
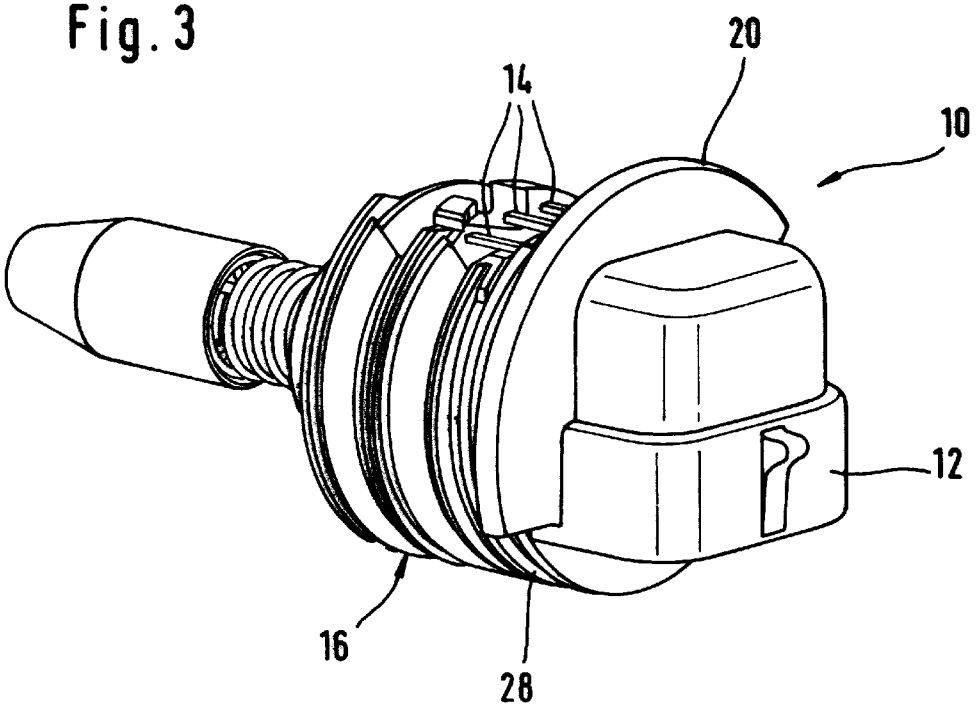
FIG. 3 is a rear perspective view of the connector of FIGS. 1 and 2 mated to the motor of an idle control valve.
Figure 4:
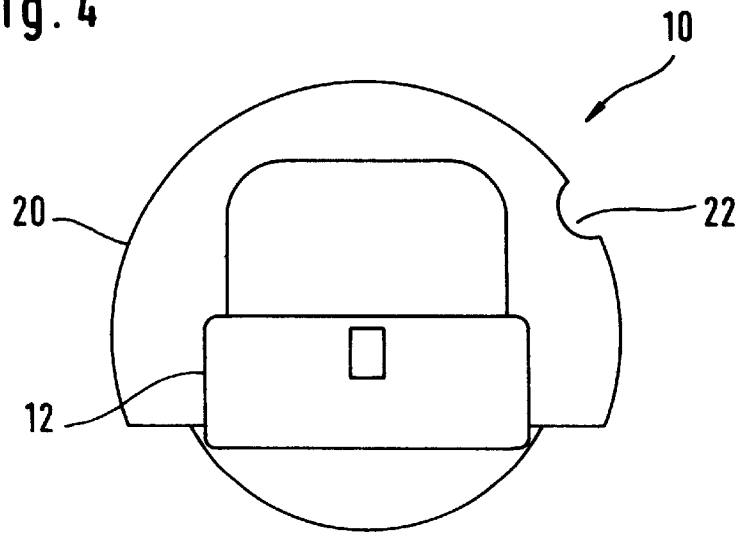
FIG. 4 is a rear view of the connector shown in FIG. 3.
Figure 5:
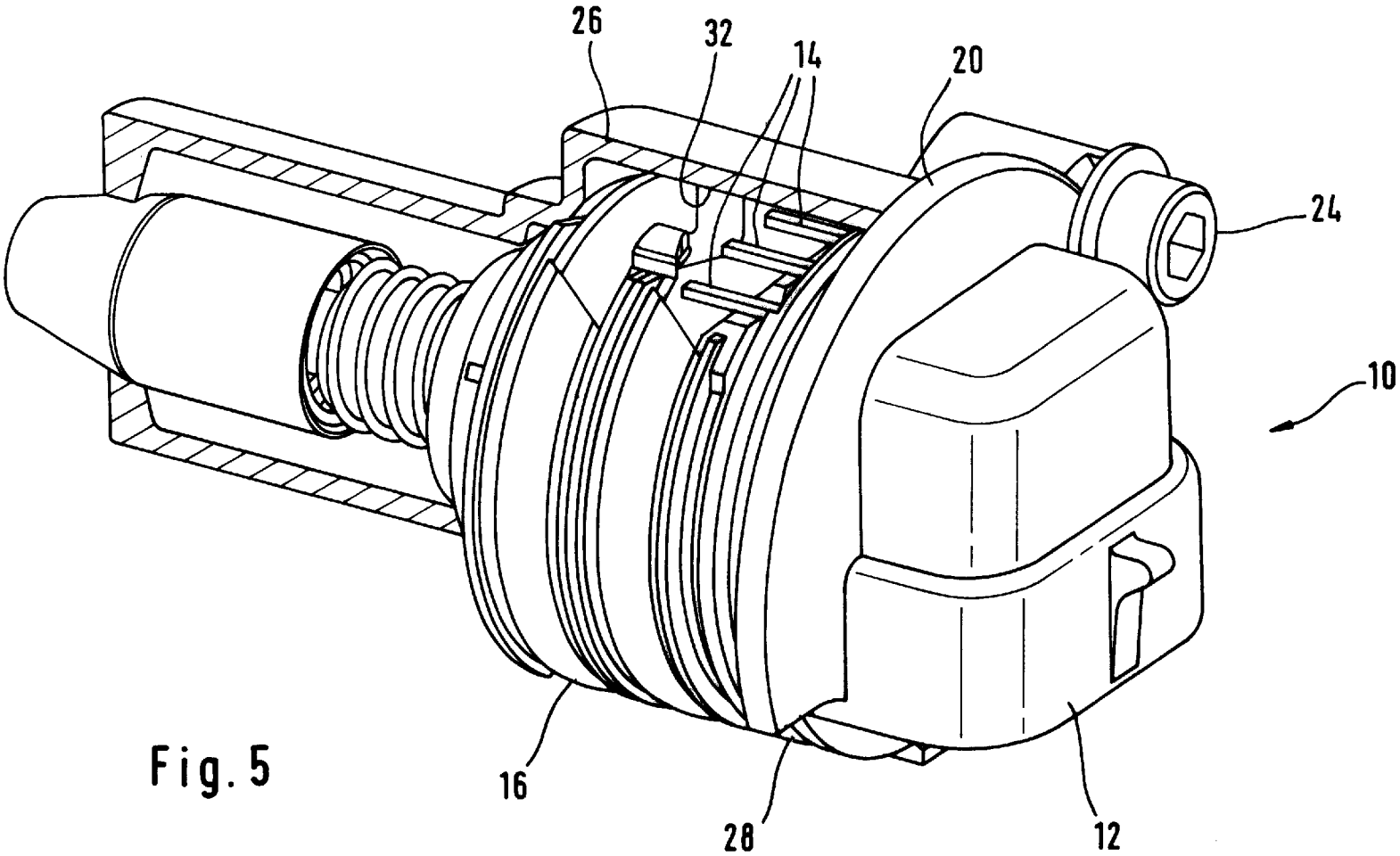
FIG. 5 is a side perspective view of the connector and motor of FIG. 3 mounted to a mating housing shown in a schematic cross-section.

Referring to the drawings of the exemplary embodiment and referring to FIGS. 1–5, the connector 10 includes a housing 12. The housing 12 is preferably constructed of monolithically injection molded dielectric material such as polybutylene terephthalate or other suitable material. As best seen in FIG. 2, supported within the connector is at least one conductive terminal 14. Terminals 14 are typically of metallic construction such as copper alloy or the like. Depending on the design criteria and preferred method of manufacturing, the terminals 14 may be over-molded in place in the housing 12 or may be inserted into preformed terminal cavities in housing 12. In this embodiment, the terminals 14 shown in FIG. 5 are connected conventionally to coil windings on the motor 16.

In this embodiment, the connector 10 is of the right-angle type. In essence, the housing has a socket 18 for receipt of a wiring plug (not shown) at an angle perpendicular to the connector's mating engagement with the electrical device, motor 16, shown in FIGS. 3 and 5. Thus, terminals 14 extend through the housing to achieve conductive engagement with the wiring plug at one end and with the motor at the other end. To accomplish this, the terminals 14 may have a bend somewhere along their length, or if the terminals are straight, the connector must be constructed to have the mating engagement at one of the ends approach from an angle relative to the surface along the length of the terminals.

The connector 10 further includes a flange 20 extending outward from at least a portion of the periphery of connector housing 12. In the embodiment shown, the flange 20 and housing 12 are dielectric material monolithically molded such that the flange 20 extends outward from the housing 12 in the area opposite the socket 18 where a wiring plug may mate with the connector 10. The flange 20 has a single mounting notch 22 formed into the flange 20 to allow the connector to be mounted in a particular angular mounting position and secured using a single mounting fastener 24, such as a bolt, shown in FIG. 5. Also, while the flange 20 may be monolithically molded with the housing 12, it also may be constructed of a different material and joined to the housing 12. For instance, the flange 20 may be metallic and over-molded to be integrally linked to the housing 12.

In the embodiment shown, a single mounting notch 22 is shown at a predetermined position to permit a mounting fastener 24 to pass through the mounting notch 22 to provide for securement of the connector 10 to the mating assembly structure 26 while preventing rotation of the connector 10 relative to the mating assembly 26. The mounting fastener 24 is shown schematically as a conventional bolt. However, connectors in accordance with the invention may be constructed to be combined with fasteners of virtually any desirable material and structure.

The flange 20 may be formed around the complete periphery of the housing 12 to allow the mounting notch 22 to be situated at any angle throughout a 360 degree arc or, as shown in FIGS. 1–5, the flange 20 may project from less than the complete periphery. The preferred embodiment shows a low-profile connector 10 wherein the socket 18 is located close to the flange 20. One skilled in the art will appreciate that if the housing 12 is elongated to locate the socket 18 further from the flange 20, then fastener access could be had to additional potential mounting notches in a flange that would continue around the housing 12.

In the embodiment shown, sealing engagement between the connector 10 and the mating assembly 26 is achieved by use of an O-ring seal 28, best seen in FIG. 5, which rests in a groove 30 in the connector housing, as seen in FIGS. 1 and 2. The O-ring seal 28 engages a bore 32 in mating assembly 26. Although the preferred embodiment shows an O-ring 28 in a groove 30 engaging a bore 32, the connector 10, the mating assembly 26 and the seal 28 therebetween may be of various shapes, configurations and constructions to provide sealing engagement between a surface of the connector and a surface of the mating assembly. Moreover, one of skill in the art will appreciate that, depending on the environment and anticipated use, the connector may not require a seal, or may have a seal of a different type between the connector and the mating assembly. Also, it will be appreciated that the connector could be configured to provide sealed engagement with the electrical device, such as the motor of the idle air control valve shown.

In accordance with the preferred embodiment, the connector 10 has a single mounting notch 22, permitting installation only at one preselected angle to prevent improper installation at a different angle. However, during the manufacture of the connector 10, the mounting notch 22 can be formed anywhere along the periphery of the flange 12 to allow the connector 10 to be mounted at any specific angle. Hence, all connectors requiring a particular connector mounting angle to achieve a particular wiring routing will have the mounting notch 22 formed at the same location on the flange 20, while connectors requiring a different mounting angle and resultant different wiring routing will have the mounting notch 22 formed on a different portion of the flange 20.

The housing 12 of the connector 10 is manufactured using a mold. The mounting notch 22 can be formed in the flange 20 using a number of methods. In one embodiment of the invention, the mounting notch 22 is formed in the flange 20 of the housing 12 by having a movable key that is inserted into the mold at a predetermined location. Thus, a single mold can be used to manufacture the housing 12 of the connector 10, and the movable dey allows the mounting notch 22 to be formed at different locations on the flange 20. In effect, this single mold allows the manufacture of a number of connectors that can be further processed so that each is adapted for mounting at a different angle.

In another embodiment, the mounting notch 22 is formed in the flange 20 after the housing 12 of the connector 10 has been molded. Thus, a single mold can be used to manufacture the housing 12 having a flange 20 with no mounting notch 22 molded in the flange 20. After the housing 12 has been molded, a mounting notch 22 is machined into the flange 20 at a predetermined location. The machining of the mounting notch 22 can be done using any of a number of methods known in the art, including drilling, grinding, or punching the mounting notch 22. Thus, a single mold can be used to manufacture the housing 12 of the connector 10, and the mounting notch 22 can be machined at different locations on the flange 20. In effect, this single mold allows the manufacture of a number of different connectors for mounting at a variety of angles.

In still another embodiment, a number of separate molds can be used, with each mold being configured to mold the housing 12 with a flange 20 having a mounting notch 22 located on a different position on the flange 20. Thus, each mold allows the manufacture of a different connector for mounting at a specific angle.

Although the preferred embodiment discloses use of a single fastener 24 and a single mounting notch 22 on the flange 20 for mounting, it will be appreciated that within the spirit of the invention, an engagement and fastening assembly could be made that requires more than one mounting notch. Such a structure may utilize more than one fastener or a combination of one or more fasteners and one or more projections or other structures to engage additional mounting notches in the flange 20. Similarly, the assembly could be made to have at least one mounting notch 22 in the flange 20 engage a projection or other structure on the mating assembly 26 to locate the connector 10 at the proper mounting angle, while using some other fastening means to secure the connector 10 in place. Therefore, the invention contemplates having connectors 10 made from one or more molds where the connectors can be adapted for use at one of a plurality of different mounting angles based on the location of a mounting notch 22 formed on the flange 20 in the manufacturing process.

It will be appreciated that the mounting notch 22 need not be of any particular shape or size, so long as it may receive a fastener or projection from the mating assembly that will assist in securing the connector 10 to the mating assembly 26 or in determining the mounting angle of the connector 10 relative to the assembly.

Hence, with this invention, connectors 10 adapted for use in different mounting angle positions can be easily manufactured by incorporating a housing 12 having a mounting notch 22 on a flange 20 around the housing 12. In a preferred embodiment, this can be done using a single mold and either having a movable key to create the mounting notch 22 when the connector housing 12 is molded, or removing material from the flange 20 to create a notch 22 on the flange 20 after the connector housing 12 has been molded. This prevents the need for additional tooling and corresponding lines of equipment to manufacture and handle a variety of different single-purpose connectors, while adding a minor manufacturing step of either moving a mold key to properly orient the mounting notch 22 or machining the mounting notch 22 at a proper location. In an alternate embodiment, multiple molds are utilized to manufacture the connectors 10, each having a mounting notch 22 at different locations on the flange 20. Moreover, if desired, a reduction of parts can be achieved by using a single fastener 24 to both orient the connector 10 to the correct mounting angle and to secure the connector 10 to the mating assembly 26.

The construction of a connector in accordance with the present invention provides numerous benefits. As seen in the exemplary embodiment, it provides a simple, cost effective, yet highly efficient single connector structure which can be adapted in the manufacturing stage for use at one of a plurality of specific mounting angles. One skilled in the art will appreciate that the present invention could be utilized in various alternative embodiments involving electrical devices that may be common in some respects but that require different mounting angles in different settings.

Although, for the purpose of explanation, use of the present invention has been depicted in a connector mated to a motor of an idle air control valve and which is mounted to a product assembly, it will be understood that the invention may be embodied in a variety of advantageous constructions of electrical connectors. Also, it should be understood that any of a variety of seals and fastening mechanisms, dimensions and suitable materials of construction may be used to satisfy the particular needs and requirements of the end user. It will be apparent from consideration of the specification and practice of the invention disclosed herein that other embodiments of the invention, as well as modifications and variations of the exemplary devices depicted may be made without departing from the scope or spirit of the invention.

What is claimed is:

1. An electrical connector adaptable for use with an electrical device having electrical connections at one of multiple angular mounting positions defined from a vertical plane, the connector comprising:

a cylindrical housing having an outer wall which is mountable at multiple angular mounting positions from the vertical plane of the electrical device, one or more conductive terminals supported by the outer wall of the housing and extending from the outer wall, and a flange extending outward from the housing, the flange having a periphery with a mounting notch therein to be fixed at any angle of the periphery of the flange, wherein an actual angular mounting position of the housing from the vertical plane of the electrical device is dependent upon the configuration of the mounting notch on the periphery of the flange.

2. An electrical connector as claimed in claim 1, wherein the conductive terminals are over-molded into the housing.

3. An electrical connector as claimed in claim 1, wherein the housing further comprises terminal cavities for receipt of the conductive terminals.

4. An electrical connector as claimed in claim 1, wherein the flange and housing are monolithically molded of a dielectric material.

5. An electrical connector as claimed in claim 1, wherein the flange extends outward from less than the entire perimeter of the housing.

6. An electrical connector as claimed in claim 1, wherein the mounting notch permits a fastener to engage the flange to mount the connector at a predetermined angle.

7. An electrical connector as claimed in claim 1, wherein the electrical connector is a right angle connector.

8. An electrical connector as claimed in claim 7, wherein a first end of the terminals is located at a first housing end and extends in a first direction and a second end of the terminals is located at a second housing end and extends in a second direction which is perpendicular to the first direction.

9. An electrical connector adaptable for use with an electrical device having electrical connections at one of multiple angular mounting positions defined from a vertical plane, the connector comprising:

a housing which is mountable at multiple angular mounting positions from the vertical plane of the electrical device, a first conductive terminal extending from the housing and mateable with the electrical connections of the electrical devices supported within the housing, a second conductive terminal coupled to the first conductive terminal and extending in a second direction which is perpendicular to the first conductive terminal, and a flange extending outward from the housing, the flange having a periphery with a mounting notch therein to be fixed at any angle of the periphery of the flange, wherein an actual angular mounting position of the housing from the vertical plane of the electrical device is dependent upon the configuration of the mounting notch on the periphery of the flange.

* * * * *